United States Patent [19]

Goudriaan et al.

[11] 4,163,707

[45] Aug. 7, 1979

[54] ASPHALT CONVERSION

[75] Inventors: Frans Goudriaan; Jakob van Klinken, both of Amsterdam, Netherlands

[73] Assignee: Shell Oil Company, Houston, Tex.

[21] Appl. No.: 905,838

[22] Filed: May 15, 1978

[30] Foreign Application Priority Data

May 18, 1977 [NL] Netherlands ..... 7705482

[51] Int. Cl.[2] ..... C10G 3/00

[52] U.S. Cl. ..... 208/44; 208/56; 208/111

[58] Field of Search ..... 208/44, 56, 111

[56] References Cited

U.S. PATENT DOCUMENTS 3,407,134 10/1968 Wunderlich et al. ..... 208/111

4,073,721 2/1978 Kanbier et al. ..... 208/251 H

FOREIGN PATENT DOCUMENTS 1034302 7/1958 Fed. Rep. of Germany ..... 208/44

*Primary Examiner*—Veronica O'Keefe

*Attorney, Agent, or Firm*—Ronald R. Reper

[57] ABSTRACT

A process is disclosed for catalytically hydroconverting asphalt in a first reactor in the presence of a hydrogenated middle distillate and hydrogen under conditions effecting both hydroconversion of the asphalt and dehydrogenation of said distillate, fractionating the reaction product into at least one distillate fraction and a residual fraction, catalytically hydrogenating the middle distillate fraction in a second reactor and circulating at least part of the second reaction product to the first reactor, and circulating hydrogenation catalyst between the first and second reactors.

7 Claims, 2 Drawing Figures

ASPHALT CONVERSION

BACKGROUND OF THE INVENTION

The invention relates to a process for the preparation of residual fuel with low sulphur content from asphalt.

As a rule, asphalt has too high a viscosity and too high a sulphur content to be used as fuel oil without modification. Both the sulphur content and the viscosity of asphalt can be reduced by mixing the asphalt with a distillate having a low sulphur content or by subjecting the asphalt to a catalytic hydrotreatment. If the difference in price between residual fuel having a low sulphur content and distillate having a low sulphur content were the only criterion in deciding which of the two solutions should be preferred, the second solution would undoubtedly have to be chosen. For, when asphalt is mixed with a distillate having a low sulphur content, a considerable quantity of relatively valuable distillate disappears into the asphalt and is sold at the residual fuel price, whereas the catalytic hydrotreatment of the asphalt yields, in addition to residual fuel having a low sulphur content as the main product, a considerable quantity of distillate having a low sulphur content as a by-product.

Processes for hydrotreatment of asphalt in the presence of a hydrogen donor are described, e.g. in U.S. Pat. No. 3,407,134 and German Pat. No. 1,034,302. Further a process for catalytic hydrogenation of heavy oil with catalyst circulating between two reactors is disclosed in applicants' recently issued U.S. Pat. No. 4,073,721.

However, a drawback of the catalytic hydrotreatment of asphalt is that it has to be carried out at a high hydrogen partial pressure, in order to avoid rapid catalyst deactivation. Generally, it may be said that in the catalytic hydrotreatment of asphalt for the preparation of residual having a low sulphur content, hydrogen partial pressures higher than 100 bar (1450 psi) should be used to reach a catalyst life acceptable for commercial application. The use of such high hydrogen partial pressure requires expensive equipment and involves a high hydrogen consumption. In view of the ample availability of asphalt and the increasing demand for residual fuel having a low sulphur content, there is an urgent need for a process permitting the catalytic hydrotreatment to be carried out at low pressure.

An investigation concerning this subject has been carried out by the Applicants. In this investigation it was found that using a hydrogen donor in combination with reactivation of the catalyst and hydrogenation of the hydrogen donor it is possible to realize a process suitable for use on a commercial scale, in which the hydrotreatment of the asphalt can be carried out at hydrogen partial pressures below 50 bar (725 psi). In this process two reactors are used, the hydrotreatment of the asphalt being carried out in one reactor and the reactivation of the catalyst and the hydrogenation of the hydrogen donor in the other reactor.

SUMMARY OF THE INVENTION

The invention provides a process for catalytically hydroconverting asphalt which comprises: (a) contacting asphalt in a first reactor with a hydrogenated middle distillate, hydrogen and with a hydrogenation catalyst at an elevated temperature and pressure and under conditions effecting both hydroconversion of the asphalt and dehydrogenation of said middle distillate; (b) separating the product from said first reactor by fractionation distillation into at least one dehydrogenation distillate fraction having a lower hydrogen content than the hydrogenated middle distillate fraction feed to the first reactor, and a residue fraction having a sulphur content lower than said asphalt; (c) contacting said dehydrogenated middle distillate fraction from step (b) in a second reactor with hydrogen and a hydrotreating catalyst under hydrogenation conditions; (d) circulating at least part of the middle distillate fraction product from the second reactor, said product having a higher hydrogen content than the feed to the second reactor, as feed to said first reactor; and (e) circulating hydrogenation catalyst from said first reactor to said second reactor and from said reactor to said first reactor.

DESCRIPTION OF THE PREFERRED EMBODIMENTS

Figure 1:
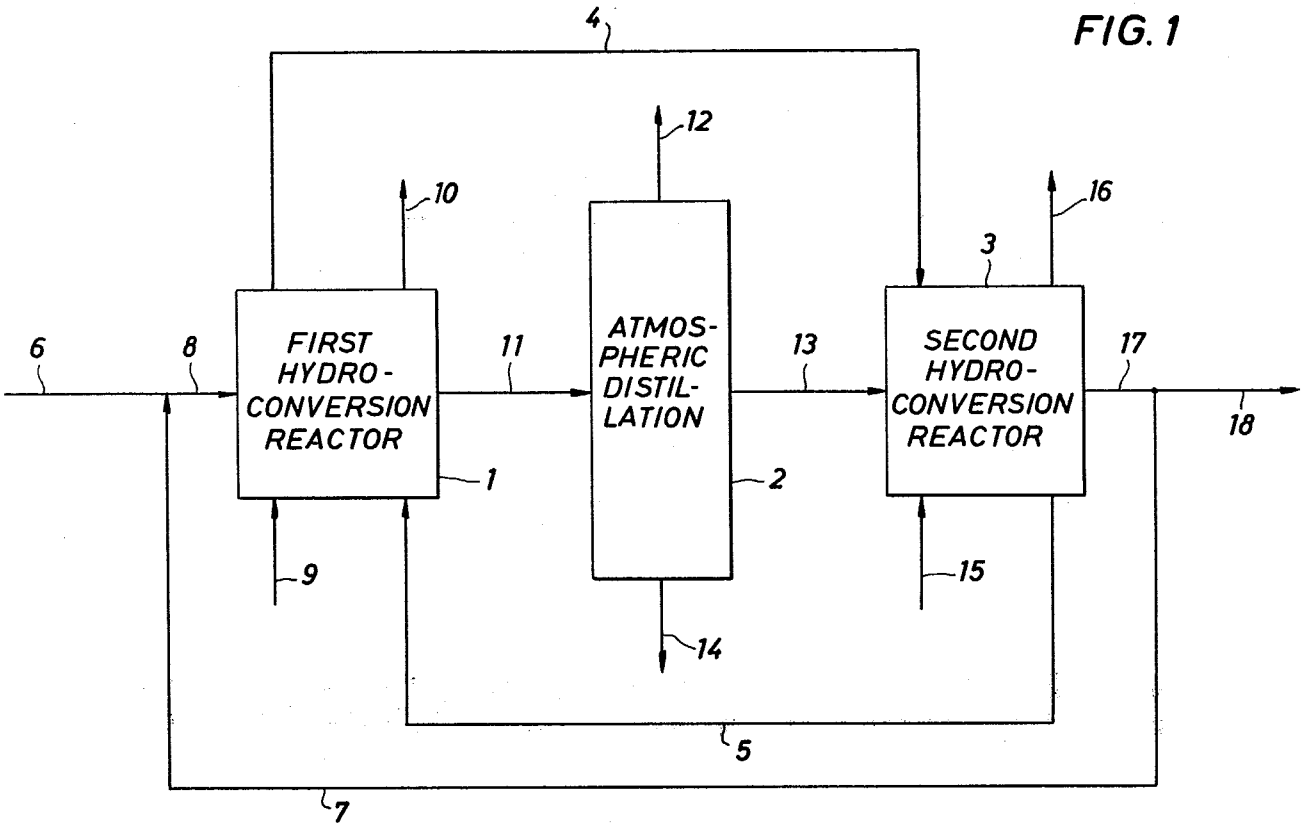
FIG. 1 schematically represents an embodiment of the hydrotreating process of the invention wherein the hydrotreatment of asphalt is carried out in one reactor, the hydrotreated product is fractionated and the reactivation of the catalyst and the hydrogenation of the hydrogen donor is carried out in a second reactor.

The hydrotreatment of the asphalt is carried out by contacting a mixture of the asphalt and a hydrogenated middle distillate as the hydrogen donor together with hydrogen in the first reactor with a catalyst having hydrogenating properties under such conditions that dehydrogenation of the middle distillate and conversion of the asphalt is effected. Hydrogenation of the hydrogen donor and reactivation of the catalyst deactivated in the hydrotreatment of the asphalt is effected by transferring the catalyst from the first reactor to the second reactor and by contacting it there in the presence of hydrogen with a dehydrogenated middle distillate separated by distillation from the product of the first reactor, under such conditions that the middle distillate is hydrogenated and the catalyst reactivated. In the distillation of the product of the first reactor the desired fuel having a low sulphur content stays behind as an atmospheric residue. After reactivation the catalyst is transferred back to the first reactor. Part of the middle distillate hydrogenated in the second reactor is used as hydrogen donor in the first reactor. In addition to an atmospheric residue having a low sulphur content which can be used as a fuel, the process also produces one or more atmospheric distillates as by-products. In the process the hydrogenated middle distillate serves in the first place as hydrogen donor for the asphalt. Moreover, the presence of the middle distillate is favorable as a diluent for the asphalt, as a result of which it can readily by pumped.

The present patent application therefore relates to a process for preparing an atmospheric hydrocarbon oil residue having a low sulphur content which can be used as a fuel and one or more atmospheric hydrocarbon oil distillates, in which process a catalyst with hydrogenating properties which circulates between two separate reactors is contacted at elevated temperature and pressure and in the presence of hydrogen with alternately a mixture of asphalt and a hydrogenated middle distillate in the first reactor under such conditions that dehydrogenation of the middle distillate is effected and with a dehydrogenated middle distillate in the second reactor under such conditions that hydrogenation of the middle distillate is effected, the reaction product of the first reactor being separated by distillation into one or more atmospheric distillates, among which there are a dehydrogenated middle distillate and an atmospheric residue having a low sulphur content, the dehydrogenated middle distillate being used as the feed for the second reactor and part of the hydrogenated middle distillate which leaves the second reactor being recycled to the first reactor.

In the process according to the invention such conditions should be used in the first reactor that dehydrogenation of the hydrogen donor is effected.

The desired conversion of the asphalt into a product with reduced viscosity and reduced sulphur content is also effected then. In the second reactor such conditions should be used that hydrogenation of the hydrogen donor takes place. The desired reactivation of the deactivated catalyst is also effected then.

The process according to the invention is preferably carried out with use of a hydrogen partial pressure lower than 50 bar (725 psi) and particularly of from about 15 to about 40 bar (218 to about 580 psi) and a space velocity of from 0.1 to 10 $l.l^{-1}.h^{-1}$ and particularly of from about 0.5 to about 5 $l.l^{-1}.h^{-1}$ in both reactors. In the first reactor a temperature of from 300° to 450° C. is preferably used and in the second reactor a temperature of from 200° to 400° C. It is preferred to use substantially the same pressure (within about ±5 bar) in both reactors. The following qualitative relation exists between temperature and hydrogen partial pressure in each of the two reactors. In the first reactor a higher temperature will have to be used according as the hydrogen partial pressure is increased in order to effect the same degree of hydrogenation of the hydrogen donor. In the second reactor a lower temperature will have to be used according as the hydrogen partial pressure is increased in order to effect the same degree of hydrogenation of the hydrogen donor.

The hydrogenation catalyst will be a supported catalyst having hydrogenating properties provided by metals or metal compounds present on the support or carrier. Very suitable metals with hydrogenating activity are metals of Groups VI and VIII of the Periodic Table of Elements. The metals may be present as such, in the form of compounds such as oxides or sulphides, or other salts.

In the process according to the invention it is preferred to use as the catalyst having hydrogenating properties a catalyst containing nickel and/or cobalt and, in addition, molybdenum and/or tungsten on a carrier. Examples of suitable carriers are alumina, silica and silica-alumina. If desired, the catalysts may contain, in addition to the above-mentioned metals, one or more promotors such as boron, phosphorus and halogen, e.g. fluorine or chlorine. The catalyst is preferably used in the sulphided form.

The process according to the invention may be carried out in two reactors, which each contain a fixed catalyst bed. In the first reactor a mixture of asphalt and hydrogenated middle distillate is passed, together with hydrogen, over a catalyst which has been reactivated in the second reactor until the hydrogenation activity of the catalyst has fallen to a certain level. In the second reactor a dehydrogenated middle distillate from the first reactor is passed, together with hydrogen, over a catalyst which has been deactivated in the first reactor until the hydrogenation activity of the catalyst has risen to a certain level. The deactivated catalyst is then transferred from the first reactor to the second reactor, the reactivated catalyst from the second reactor is transferred to the first reactor and the process is continued. The process according to the invention is preferably carried out in two reactors, which each contain a "moving fixed catalyst bed". By the term moving fixed catalyst bed is meant a fixed catalyst bed which slowly moves through a vertically disposed reactor by continuously or periodically adding catalyst to the top of the bed and continuously or periodically removing catalyst from the bottom of the bed. Catalyst transport from one reactor to the other reactor can very conveniently be effected by pumping a slurry of the catalyst in oil. Such a moving fixed bed process is described in British Pat. No. 1,331,935.

In the process according to the invention deposition of vanadium from the asphalt on the catalyst takes place in the first reactor. As no vanadium is removed from the catalyst in the reactivation of the catalyst in the second reactor, the vanadium content of the catalyst will gradually increase. To take care that the vanadium content of the catalyst remains below a certain value, part of the vanadium-containing catalyst should continuously or periodically be replaced by the same volume of a fresh catalyst or of a catalyst used earlier in the process after its vanadium content has been reduced.

The process according to the invention is very suitable to be used as part of a more extensive process for preparing atmospheric hydrocarbon oil distillates and an atmospheric hydrocarbon oil residue having a low sulphur content which can be used as fuel. Such a process can be carried out as follows. A vacuum residue is separated by deasphalting into a deasphalted oil and asphalt. After catalytic hydrotreatment in the second reactor, the deasphalted oil is converted by catalytic cracking or hydrocracking into one or more atmospheric hydrocarbon oil distillates. Processing of the asphalt is carried out in the first reactor. When the process according to the invention is carried out as part of a more extensive process for preparing atmospheric hydrocarbon oil distillates and an atmospheric hydrocarbon oil residue having a low sulphur content which can be used as fuel, an atmospheric residue instead of a vacuum residue may also be used as the starting material. The atmospheric residue is then separated by vacuum distillation into a vacuum distillate and a vacuum residue and the vacuum residue is split up by deasphalting into a deasphalted oil and asphalt. After catalytic hydrotreatment of the vacuum distillate thus obtained and/or the deasphalted oil thus obtained in the second reactor, these oils are converted by catalytic cracking or hydrocracking into one or more atmospheric hydrocarbon oil distillates. In that case, too, processing of the asphalt is carried out in the first reactor.

In the process according to the invention use is made of a middle distillate which circulates between the two reactors and which alternately takes up hydrogen in the second reactor and gives off hydrogen in the first reactor. As during the process middle distillate is formed in the first reactor through the cracking of asphalt, part of the middle distillate should be withdrawn from the circulation. This withdrawal may be carried out before the second reactor, in which case, of the middle distillate leaving the first reactor, only the part which is required as hydrogen donor in the first reactor is passed through the second reactor. It is also possible to pass the total quantity of the middle distillate leaving the first reactor through the second reactor and to separate from the hydrogenated middle distillate leaving the second reactor a part as the end product. If the process according to the invention is carried out as part of one of the more extensive processes described above, in which catalytic cracking or hydrocracking is used for preparing gasoline, the part of the middle distillate present in the reaction product of the first reactor can very suitably be used as a feed component for the cracking unit.

If in the process according to the invention catalytic cracking or hydrocracking of a deasphalted oil or of a vacuum distillate and a deasphalted oil is used, a considerable part of the feed concerned is converted into atmospheric distillates, which are separated from the cracked product by distillation. To increase the yield of desired distillates the residue obtained in the distillation is preferably at least partly recycled to the cracking unit. In the catalytic cracking process, which is preferably carried out in the presence of a zeolitic catalyst, coke is deposited on the catalyst. This coke is removed from the catalyst by burning off during a catalyst regeneration step that is combined with the catalytic cracking, whereby a waste gas is obtained which contains carbon dioxide. Catalytic cracking is preferably carried out at an average temperature of from 400° to 550° C. and particularly of from about 450° to about 525° C., a pressure of from 1 to 10 bar (14.5 to 145 psi) and particularly of from about 1.5 to 7.5 bar (22.5 to 109 psi), a space velocity of from 0.25 to 4 $kg.kg^{-1}.h^{-1}$ and particularly of from about 0.5 to 2.5 $kg.kg^{-1}.h^{-1}$ and a rate of catalyst replacement of from 0.1 to 5 and particularly of from about 0.2 to about 2 tonnes of catalyst per 1000 tonnes of feed.

If the process according to the invention is combined with hydrocracking of a deasphalted oil or of a deasphalted oil and a vacuum distillate, this hydrocracking is preferably carried out as a two-stage process, in which the hydrocracking proper, which is effected in the second stage, is preceded by a catalytic hydrotreatment mainly with the object of reducing the nitrogen content and the content of polyaromatics of the feed to be hydrocracked. Suitable catalysts to be used in the one-stage hydrocracking process and in the second stage of the two-stage hydrocracking process are moderately acid and strongly acid catalysts comprising one or more metals having hydrogenating activity on a carrier. Hydrocracking is preferably carried out at an average temperature of from 250° to 450° C. and particularly of from about 300° to about 425° C., a hydrogen partial pressure of from 1 to 200 bar(14.5 to 2900 psi) and particularly below 50 bar (725 psi), a space velocity of from about 0.1 to about 10 $kg.l^{-1}.h^{-1}$ and particularly of from about 0.25 to about 2 $kg.l^{-1}.h^{-1}$ and a hydrogen/feed ratio of from 200 to 3000 $Nl.kg^{-1}$ and particularly of from about 500 to about 2000 $Nl.kg^{-1}$. Hydrocracking is preferably carried out at a hydrogen partial pressure that is equal to the one used in the first and/or second catalytic hydrotreatment. When the hydrocracking is carried out according to the two-stage process it is preferred to use the complete reaction product from the first stage (without ammonia, hydrogen sulphide or any other volatile components being separated from it) as the feed for the second stage.

If in the process according to the invention a deasphalting treatment is used, it is preferably carried out at elevated temperature and pressure and in the presence of an excess of a light hydrocarbon as the solvent.

Two process schemes for the conversion of asphalt and of an atmospheric residue into light hydrocarbon oil distillates and fuel oil will hereinafter be explained in more detail with reference to the following drawings.

Process Scheme I (FIG. 1)

The process is carried out in an apparatus comprising successively the first catalytic hydrotreating section (1), an atmospheric distillation section (2) and the second catalytic hydrotreating section (3). Both catalytic hydrotreating sections contain a moving fixed catalyst bed. Deactivated catalyst flows via line (4) and reactivated catalyst flows via line (5). Asphalt (6) obtained by deasphalting a vacuum residue is mixed with an oil (7) and the mixture (8), together with a hydrogen stream (9), is subjected to a catalytic hydrotreatment. After separation of a gas stream (10), substantially consisting of $C_4$ and lighter ($C_4-$) hydrocarbons and $H_2S$, from the hydrotreated product, the liquid reaction product (11) is separated by atmospheric distillation into a gasoline fraction (12), a middle distillate fraction (13) and a residue (14). The middle distillate fraction (13) is subjected to a catalytic hydrotreatment together with a hydrogen stream (15). After separation of a gas stream (16), substantially consisting of $H_2S$, from the hydrotreated product, the liquid reaction product (17) is separated into two portions (7) and (18) having the same composition.

Figure 2:
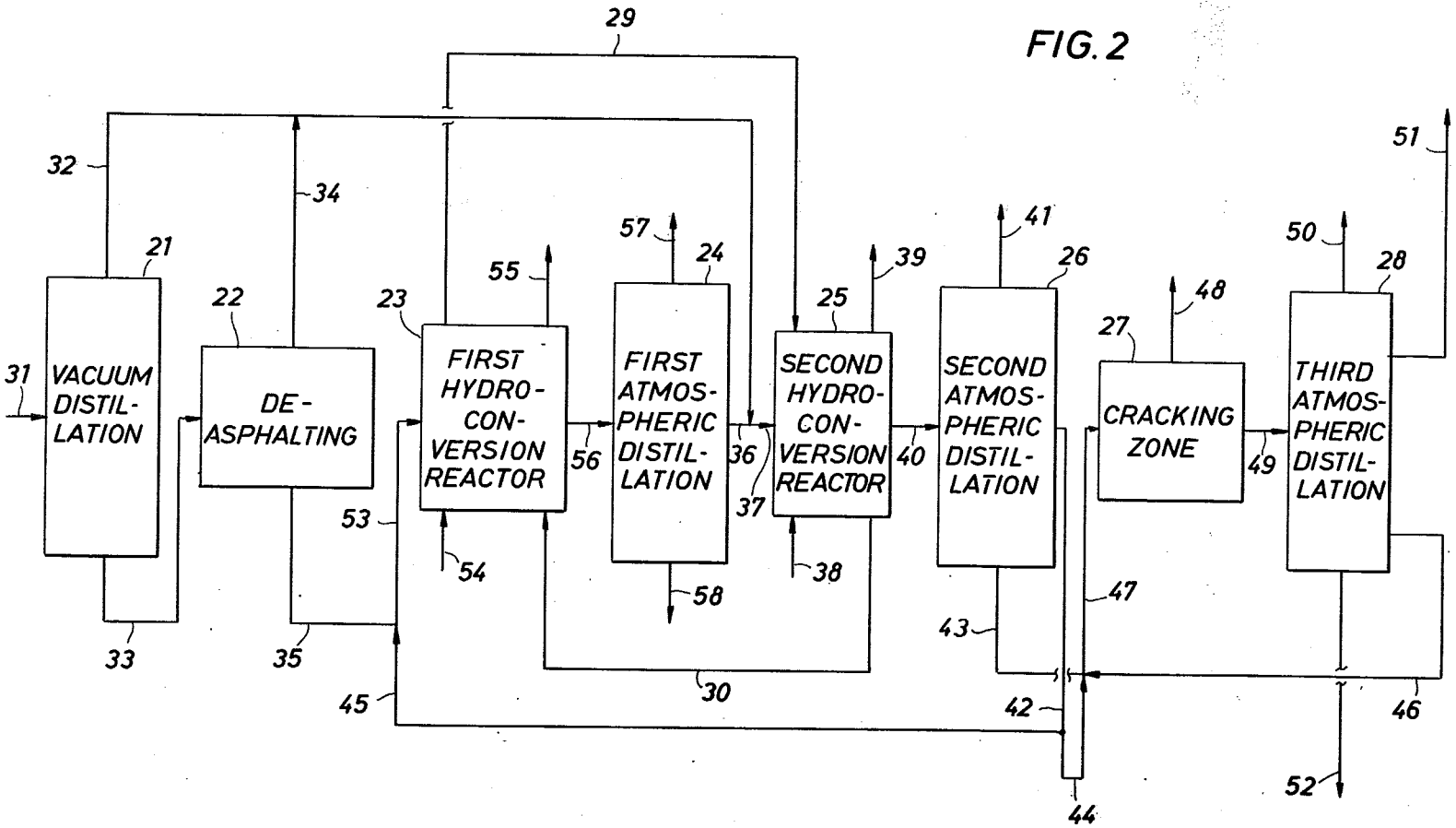
FIG. 2 schematically represents a more extensive embodiment of the invention.

Process Scheme II (FIG. 2)

The process is carried out in an apparatus comprising successively a vacuum distillation section (21), a deasphalting section (22), the first catalytic hydrotreating section (23), the first atmospheric distillation section (24), the second catalytic hydrotreating section (25), the second atmospheric distillation section (26), a cracking zone (herein a catalytic cracking zone) (27) and the third atmospheric distillation section (28). Both catalytic hydrotreating sections contain a moving fixed catalyst bed. Deactivated catalyst flows via line (29) and reactivated catalyst flows via line (30). A hydrocarbon oil residue (31) obtained by atmospheric distillation is separated by vacuum distillation into a vacuum distillate (32) and a vacuum residue (33). The vacuum residue (34) is separated by deasphalting into a deasphalted oil (35) and an asphalt (36). The vacuum distillate (37), the deasphalted oil (34) and a middle distillate fraction (36) are mixed and the mixture (37) is subjected to a catalytic hydrotreatment together with a hydrogen stream (38). After separation of a gas stream (39) substantially consisting of $C_4-$ hydrocarbons, and $H_2S$ from the hydrotreated product, the liquid reaction product (40) is separated by atmospheric distillation into a gasoline fraction (41), a middle distillate fraction (42) and a residue (43). The middle distillate fraction (42) is separated into two portions (44) and (45) having the same composition. The residue (43) is mixed with portion (44) and with a middle distillate fraction (46) and the mixture (47) is catalytically cracked. In the regeneration of the catalyst in the catalytic cracking section a waste gas (48) is obtained containing carbon dioxide. The catalytically cracked product (49) is separated by atmospheric distillation into a $C_4-$ fraction (50), a gasoline fraction (51), a middle distillate fraction (46) and a residue (52) being a mixture of heavy cycle oil and slurry oil. The asphalt (35) is mixed with the middle distillate fraction (45) and the mixture (53) is subjected to a catalytic hydrotreatment together with a hydrogen stream (54). After separation of a gas stream (55) substantially consisting of $C_4-$ hydrocarbons and $H_2S$ from the hydrotreated product, the liquid reaction product (56) is separated by atmospheric distillation into a gasoline fraction (57), a middle distillate fraction (36) and a residue (58).

The present patent application also comprises apparatuses carrying out the process according to the invention as schematically shown in FIGS. 1 and 2.

The invention will now be elucidated with reference to the following examples.

The process according to the invention was applied to an atmospheric distillation residue of a crude oil from the Middle East and to an asphalt which had been prepared from this atmospheric distillation residue by vacuum distillation and deasphalting of the vacuum residue thus obtained. The atmospheric distillation residue had an initial boiling point of 370° C., a sulphur content of 4.1%w, a vanadium content of 56 ppmw, a CCT (Conradson Carbon Test value) of 10% and a kinematic viscosity at 210° F. ($V_{k210}$) of 67 centistokes (cSt). The asphalt which had been obtained as an intermediary product in one case and was used as the starting material in the other had a sulphur content of 6.7%w, a vanadium content of 210 parts per million by weight (ppmw), a CCT of 34% and a Ring and Ball softening point of 110° C. The process was carried out according to process schemes I and II. In the sections the following conditions were used.

In both process schemes the catalytic hydrotreatment in the first hydroconversion reactor (1) was carried out at a temperature of 425° C., a pressure of 35 bar (508 psi), a space velocity of 0.25 kg asphalt.$l^{-1}.h^{-1}$ and a $H_2$/asphalt ratio of 500 Nl.$kg^{-1}$. The average residence time of the catalyst in the first reactor (1) was 1200 hours. In process scheme I the catalytic hydrotreatment in the second hydroconversion reactor (3) was carried out at a temperature of 290° C., a pressure of 35 bar (508 psi), a space velocity of 0.50 kg oil.$l^{-1}.h^{-1}$ and a $H_2$/oil ratio of 500 Nl.$kg^{-1}$. The average residence time of the catalyst in reactor (3) was 800 hours.

In process scheme II the catalyst hydrotreatment in reactor (23) was carried out at a temperature of 425° C., a pressure of 35 bar (508 psi), a space velocity of 0.25 kg asphalt.$l^{-1}.h^{-1}$ and a $H_2$/asphalt ratio of 500 Nl.$kg^{-1}$. The average residence time of the catalyst in reactor (23) was 1200 hours. In process scheme II the catalytic hydrotreatment in reactor (25) was carried out at a temperature of 370° C., a pressure of 35 bar (508 psi), a space velocity of 1.5 kg oil.$l^{-1}.h^{-1}$ and a $H_2$/oil ratio of 500 Nl.$kg^{-1}$. The average residence time of the catalyst in reactor (25) was 900 hours. The catalytic cracking was carried out in the presence of a zeolitic catalyst at a temperature of 490° C., a pressure of 2.2 bar (31.9 psi) and a space velocity of 2 kg oil.$kg^{-1}.h^{-1}$. The deasphalting was carried out at 145° C. and 41 bar with butane as the solvent and a solvent/oil weight ratio of 4:1.

EXAMPLE 1

This example was carried out according to process scheme I. The various streams were present in the following quantities:

100 pbw asphalt (6),
117 pbw oil (7) with a hydrogen content of 10.92%w,
0.6 pbw hydrogen (9),
10.3 pbw $C_4-$ fraction $+H_2S$ (10),
10.0 pbw $C_5-200°$ C. gasoline fraction (12),
135.0 pbw 200°-370° C. middle distillate fraction (13) with a hydrogen content of 10.16%w
62.3 pbw 370° C.+ residue (14) with a sulphur content of 3.7%w, a vanadium content of 47 ppmw, a CCT smaller than 10% and a $V_{k210}$ of 310 cSt.
1.15 pbw hydrogen (15),
0.15 pbw $H_2S$,
136 pbw liquid product, and
19 pbw portion (18) with a sulphur content smaller than 0.05%w.

EXAMPLE 2

This example was carried out according to process scheme II. The various streams were present in the following quantities:

100 pbw 370° C.+ atmospheric distillation residue (31),
49.2 pbw 370°-520° C. vacuum distillate (32),
50.8 pbw 520° C.+ vacuum residue (33),
26.8 pbw deasphalted oil (34),
24.0 pbw asphalt (35),
108.4 pbw mixture (37),
0.75 pbw hydrogen (38),
2.6 pbw $C_4-$ fraction $+H_2S$ (39),
20.0 pbw $C_5-200°$ C. gasoline fraction (41)
32.1 pbw 200°-370° C. middle distillate fraction (42) with a hydrogen content of 10.92%w,
72.83 pbw 370° C.+ residue (43),
4.0 pbw portion (44),
28.1 pbw portion (45),
88.5 pbw mixture (47),
16.2 pbw $C_4-$ fraction (50),
43.1 pbw $C_5-200°$ C. gasoline fraction (51),
11.6 pbw 200°-370° C. middle distillate fraction (46),
12.3 pbw 370° C.+ residue (52),
52.1 pbw mixture (53),
0.14 pbw hydrogen (54),
2.5 pbw $C_4-$fraction$+H_2S$ (55),
2.4 pbw $C_5-200°$ C. gasoline fraction (57),
32.4 pbw 200°-370° C. middle distillate fraction (36) with a hydrogen content of 10.16% w, and
14.9 pbw 370° $C^+$ residue (58) with a sulphur content of 3.7% w and a vanadium content of 47 ppmw, a CCT smaller than 10% and a $V_{k210}$ of 310 cSt.

We claim as our invention:

1. A process for catalytically hydroconverting asphalt which comprises: (a) contacting asphalt in a first reactor with a hydrogenated middle distillate, hydrogen and with a hydrogenation catalyst at an elevated temperature and pressure and under conditions effecting both hydroconversion of the asphalt and dehydrogenation of said middle distillate; (b) separating the product from said first reactor by fractionation distillation into at least one dehydrogenated distillate fraction having a lower hydrogen content than the hydrogenated middle distillate fraction feed to the first reactor, and a residue fraction having a sulphur content lower than said asphalt; (c) contacting said dehydrogenated middle distillate fraction from step (b) in a second reactor with hydrogen and a hydrotreating catalyst under hydrogenation conditions; (d) circulating at least part of the middle distillate fraction product from the second reactor, said product having a higher hydrogen content than the feed to the second reactor, as feed to said first reactor (e) circulating hydrogenation catalyst from said first reactor to said second reactor and from said second reactor to said first reactor, and (f) withdrawing the residue fraction from said first reactor.

2. A process according to claim 1, wherein in both reactors a hydrogen partial pressure is used lower than 50 bar (725 psi) and a space velocity is used in the range of 0.1–10 $l.l^{-1}.h^{-1}$.

3. A process according to claim 1 or 2, wherein in the first reactor a temperature is used of from 300° to 450° C. and in the second reactor a temperature of from 200° to 400° C.

4. A process according to claim 1, wherein in both reactors substantially the same pressure is used.

5. A process as in claim 2 wherein the hydrogen partial pressure is from about 15 to about 40 bar (217.5 to about 580 psi) and the space velocity is from about 0.5 to about $1-1^{-1}.h^{-1}$.

6. A process as in claim 1 wherein the catalyst comprises at least one Group VI metal and at least one Group VIII metal on a support selected from alumina, silica and silica alumina.

7. A process according to claim 6 wherein a catalyst is used which contains at least one metal or metal compound selected from nickel and cobalt and, in addition, one metal or metal compound selected from molybdenum and tungsten.

* * * * *